US010352005B1

(12) United States Patent
Mendendorp

(10) Patent No.: US 10,352,005 B1
(45) Date of Patent: Jul. 16, 2019

(54) SCREED APPARATUS

(71) Applicant: Kraft Tool Company, Shawnee, KS (US)

(72) Inventor: David Mendendorp, Fall River, WI (US)

(73) Assignee: Kraft Tool Company, Shawnee, KS (US)

( * ) Notice: Subject to any disclaimer, the term of this patent is extended or adjusted under 35 U.S.C. 154(b) by 0 days.

(21) Appl. No.: 16/153,375

(22) Filed: Oct. 5, 2018

(51) Int. Cl.
*E01C 19/44* (2006.01)
*E04F 21/24* (2006.01)

(52) U.S. Cl.
CPC ..... *E01C 19/44* (2013.01); *E04F 21/241* (2013.01)

(58) Field of Classification Search
CPC ..... E01C 19/44; E04F 21/241
USPC ..... 404/96, 94, 114, 118
See application file for complete search history.

(56) References Cited

U.S. PATENT DOCUMENTS 2,586,472 A * 2/1952 McKown ..... A47L 13/02 15/176.3
4,641,995 A * 2/1987 Owens ..... E04G 21/10 404/114
4,702,641 A * 10/1987 Naser ..... E01C 19/44 15/235.8
4,828,427 A * 5/1989 Nisenbaum ..... B25G 1/00 15/144.1
D306,963 S * 4/1990 Morrison ..... E01C 19/44 D8/45
5,540,519 A * 7/1996 Weber ..... E01C 19/402 15/235.4
5,605,415 A * 2/1997 Shamblin ..... E01C 19/44 15/235.8
5,609,437 A * 3/1997 Silva ..... E01C 19/44 15/235.4
5,676,489 A * 10/1997 Willhoite ..... E01C 19/187 404/101
5,727,279 A * 3/1998 Pike, Jr. ..... E01C 19/44 15/235.4
5,980,154 A * 11/1999 Record ..... E04F 21/04 404/118
6,488,442 B2 * 12/2002 Boudreaux, Sr. ..... E01C 19/44 404/118
D483,632 S * 12/2003 Masseria ..... E01C 19/44 D8/45
6,728,994 B1 * 5/2004 Rushin, Jr. ..... E04F 21/241 16/422
7,153,058 B2 * 12/2006 Lindley ..... E01C 19/402 404/118
7,204,659 B2 * 4/2007 Schmitt ..... E01C 19/402 404/118
2003/0146365 A1 * 8/2003 Miller ..... E01C 19/502 249/3
2007/0154260 A1 * 7/2007 Lindley ..... E01C 19/402 404/114

(Continued)

*Primary Examiner* — Raymond W Addie
(74) *Attorney, Agent, or Firm* — Erickson Kernell IP, LLC; John C. McMahon

(57) ABSTRACT

A screed having a rectangular tube with a pair of cross braces. A rod extends the length of each cross brace and has threaded bores at the end thereof. The cross braces have legs that extend outward to the sides of the tube from the rod. An end plate is mounted on each end of the screen and is attached thereto by screws received in the threaded bores and passing through openings in the end plates.

3 Claims, 2 Drawing Sheets

(56) References Cited

U.S. PATENT DOCUMENTS

| | | | | |
|---|---|---|---|---|
| 2015/0284917 | A1* | 10/2015 | Angel | E01C 19/402<br>404/114 |
| 2017/0218576 | A1* | 8/2017 | Lindley | E01C 19/402 |
| 2018/0127928 | A1* | 5/2018 | Terstriep | E04F 21/05 |
| 2018/0202175 | A1* | 7/2018 | Lindley | E01C 19/44 |

* cited by examiner

Fig. 1.
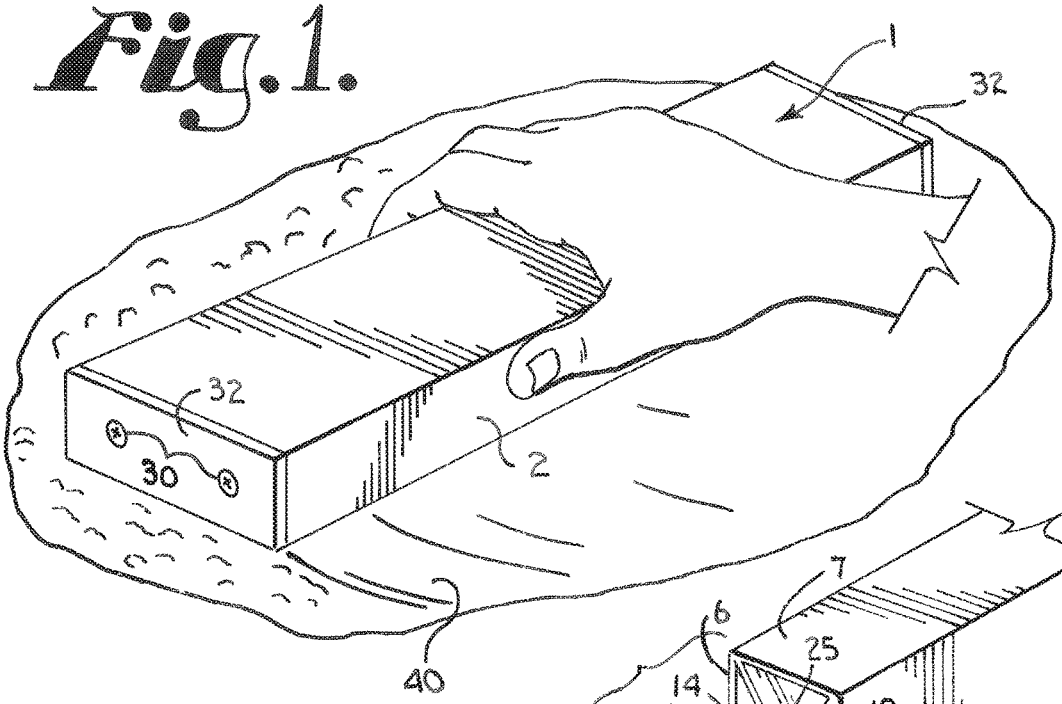
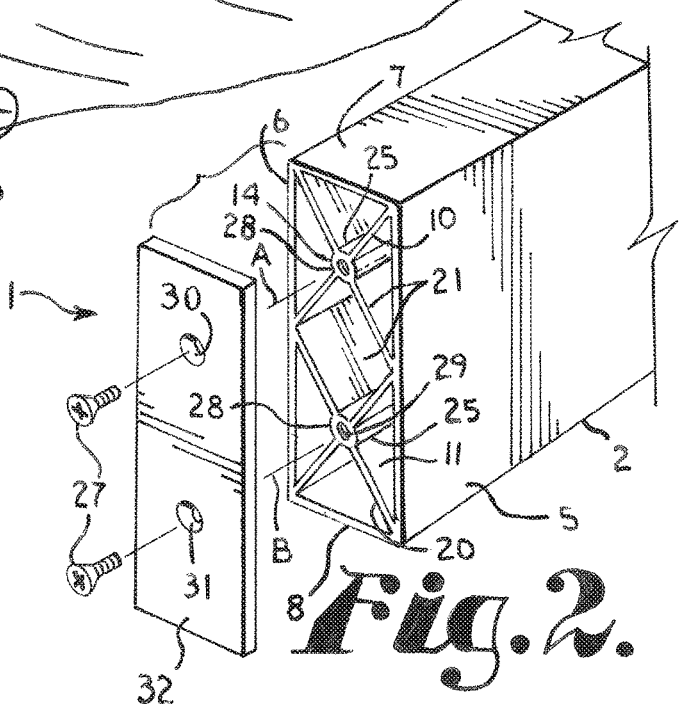
Fig. 2.
PRIOR ART
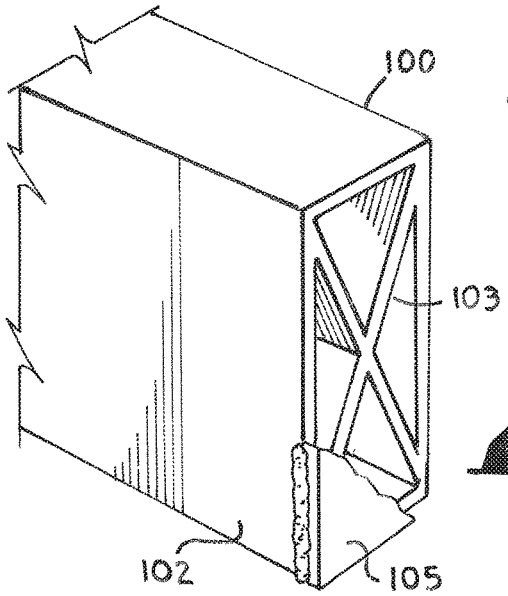
Fig. 4.

SCREED APPARATUS

BACKGROUND OF THE INVENTION

The invention is in the field of screeds utilized to smooth the surface of construction materials, such as freshly laid concrete, stucco, and plaster.

Conventional screeds are a type of hand tool used in finishing concrete, cement, stucco, plaster and the like to provide a smooth surface. As the screeds are hand worked, it is important to use light weight material to make the screeds. However, it is also important that the screeds resist bending or warping in order to ensure a flat or smooth surface is left after the screed is applied to the material being laid and finished.

Because of these requirements, aluminum has conventionally been used for screeds as it satisfies most requirements and is relatively inexpensive. In order to keep weight down, screeds are often rectangular in cross section and hollow; however, in order to retain resistance to bending under load or warping, the interior has an x-shaped support that extends between opposed corners of the screed and runs the entire length thereof. The x-shape essentially forms four triangles and triangles are the most stable construction element.

Finally, the ends of the rectangular shaped tube forming the screen has open ends that are covered by plates to prevent building materials, such as concrete, from filing the interior which would greatly increase the working weight of the screed.

In order to prevent materials from entering the interior, end caps or plates have typically been welded to the ends. In the overall process of making the screed, the body is easily extruded; however, in the current art, the addition of the end cap by welding and subsequent sanding to smooth edges, adds significant steps to the process of making the screed, which results in substantial added cost due to additional man hours spent to add the caps.

SUMMARY OF THE INVENTION

An extruded screed is formed of four aluminum walls joined at corners to form an elongate mostly hollow sleeve or tool of rectangular cross section. Extending from each corner on the interior of the screed are x-shaped supports or braces that are each joined to the walls at two corners and to each other and the walls spaced from the corners. As the walls and x-shaped supports are preferably simultaneously extruded, the screed sleeve is integrally constructed. The x-shaped supports produce a number of triangles on the interior of the sleeve that resist bending or bowing of the sleeve. The sleeve with the walls and supports are extruded in long lengths while hot and cut into desired lengths after cooling sufficiently to solidify. The middle of each x-shaped support has an axis where the legs of each x-shaped support join. The middle of the present invention is expanded beyond the thickness of each leg, so as to increase from an elongate cylindrical shaped body in the middle of the sleeve running along the axis with a cross section sufficient to be bored and threaded at the center of each end to form a pair of receivers. An end cap is applied to each end of the screed with appropriate screws or other fasteners to fit a respective receiver and be held thereby. In this manner, the end caps are secured to each end of the screed. The body at the middle of the x-supports may be of various shapes, such as square or rectangle, but a circular cross section is preferred, so that the middle is cylindrical in shape and at least several times greater in width than the thickness of the legs.

Other objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

BRIEF DESCRIPTION OF THE DRAWINGS

The present invention will now be described in more details with reference to preferred embodiments of the invention, given only by way of example, and illustrated in the accompanying drawings in which:

FIG. 1 is a perspective view of a first hand held screed being utilized to smooth the surface of freshly poured concrete.

FIG. 2 is an exploded and partial perspective view of the first screed detailing interior and an end cap thereof.

FIG. 4 is a partial perspective view of a prior art screed detailing interior thereof and with an end cap partly broken away.

DETAILED DESCRIPTION

Figure 3:
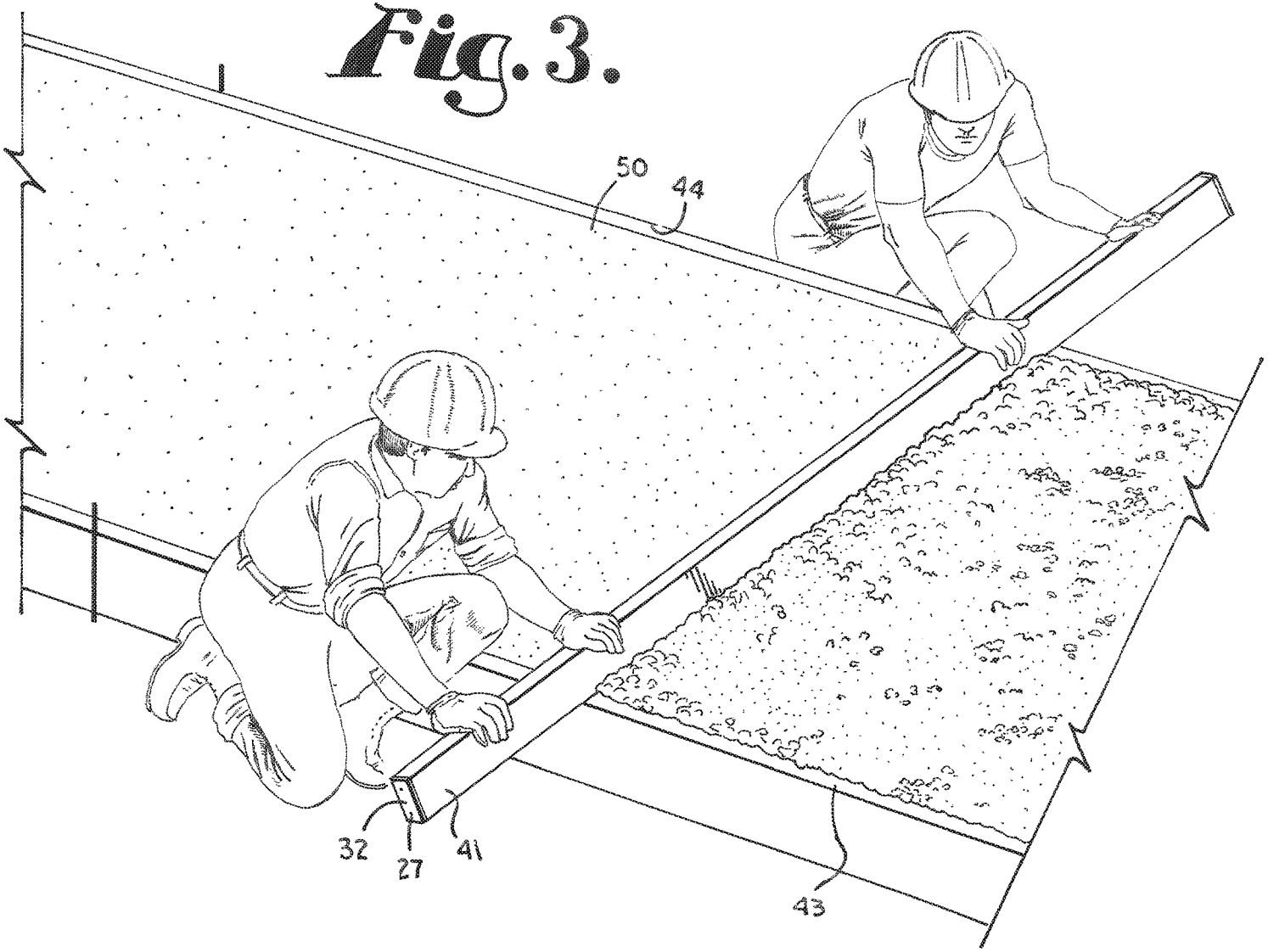
FIG. 3 is a perspective view of a second screed showing utilization of the second screed in association with guide rails to hand smooth the surface of freshly poured concrete.

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

A prior art screed 100 is shown in FIG. 4. It has a rectangular shaped tube 102 with an interior x-shaped cross bracing 103 that extends between corners of the tube 100 on one side and the side of the tube 102 on the other side. An end plate 105 (partially shown in FIG. 4) is welded to the end of the tube 102.

Shown in FIGS. 1 and 2 is a screed 1 in accordance with the present invention. The screed 1 has a thin walled and generally rectangular shaped enclosure, sleeve, or tube 2. The tube 2 includes a first pair of walls 5 and 6 having a first width and a second pair of walls 7 and 8 having a second width. Preferably, the first width is slightly more than twice the second width and further preferably the first width is 3.5 inches and the second width is 1.5 inches, although it is foreseen that various sizes would be functional within the scope of the invention. Each of the walls 5, 6, 7, and 8 are thin walled, preferably having a thickness of about $1/16^{th}$ of an inch. The walls 5, 6, 7, and 8, as well as the screed 1, overall is preferably constructed of extruded aluminum.

Located on the interior of the tube 2 are a pair of x-shaped braces or supports 10 and 11. The supports 10 and 11 are adjacent and abutting each other as well as the tube 2 and fixedly secured thereto. Each of the braces 10 and 11 include a center 14 having axes A and B from which radially extend four vanes or legs 20 that are angularly spaced from each other. As seen in FIG. 2, a first pair of each legs 20 extends to a pair of corners of the tube 2 and a second pair 21 extend to and engage the corresponding legs 21 on the opposite brace 10 or 11. Preferably, the legs are each $1/16^{th}$ of an inch in thickness.

Located in the center of each brace 10 and 11 is a core or rod 25 that has a diameter that is substantially thicker than the width of each leg 20 or 21 and is at least twice as thick. Preferably, the rod 25 is at least five times thicker than the legs 20 and is $5/16^{th}$ of an inch in thickness. The tube 2, the x-shaped braces 10 and 11 with the legs 20 and 21 and the rods 25, all extend the length of the screed tube 2 and are integrally formed with each other in an extrusion process so as to produce a rigid and smooth surfaced structure suitable for finishing freshly laid construction materials, such as concrete, stucco, and plaster. Opposite ends 28 of each rod 25 are bored and threaded to form a receiver 29 adapted to receive a fastener 30.

End caps or plates 32 are mounted on opposite ends of the tube 2. The end plates 32 are the same size as a cross section of the tube 2 perpendicular to the axes A and B, that is 3.5 by 1.5 inches. The end plates 32 include two bores 30 and 31 that are aligned to overlay the bores 29 and also receive the screws 27. The bores 30 and 31 are counter sunk and the screws 27 are of a counter sink type, so as to have a low profile when in use. The end plates 32, in conjunction with the tube 2, form an entirely enclosed screed 1. If necessary, the end plates 32 may be sanded to form a smooth transition with respect to the tube 2, but preferably require no sanding. The endplates are preferably $1/8^{th}$ inch in thickness.

In use, the screed 1 is used to smooth a freshly laid surface 40, such as in FIG. 1, or as is shown in FIG. 3, a longer screed 41 may be mounted on spaced rails 43 and 44 to smooth material 50. The screeds 1 and 41 are produced by a continuous extrusion process wherein screeds of a desired length are simply cut from a longer extrusion and then end plates 32 are placed thereon.

It is to be understood that while certain forms of the present invention have been illustrated and described herein, it is not to be limited to the specific forms or arrangement of parts described and shown.

Having thus described the invention what is claimed as new and desired to be secured by Letters Patent is as follows:

1. A screed comprising:

a) first and second parallel side walls each having the same length and width and third and fourth parallel side walls each having the same length and width; the first sidewall and third sidewalls each being fixedly joined at a first set of opposed edges along the length thereof and the second and fourth sidewalls each being fixedly joined at a second set of opposed edges along the length thereof so as to form a rigid rectangular shaped and hollow tube;

b) first and second x-shaped supports, each support having four legs joined along a center axis of the screed; each leg having an outer end spaced away from the center axis and being joined to the interior of the tube; each leg extending the length of the tube along the center axis and having a common length;

c) a rod structure centrally mounted about the axis and both fixedly and integrally joined to each of the legs; the rod structure being substantially thicker in width then the legs; the rod structure extending the length of the tube and having threaded bores at opposite ends thereof; and d) a pair of end plates; one end plate being mounted on a respective end of the tube; each end plate having a pair of bores that each receive a screw and are secured to the bores in the center bar.

2. The screed according to claim 1 wherein:

a) the tube is 1½ inches by 3½ inches in width and depth;

b) the tube walls and legs are constructed of aluminum that is $1/16^{th}$ inch in thickness.

3. The screed according to claim 2 wherein the end plate is approximately $1/8^{th}$ inch in thickness.

* * * * *